United States Patent [19]

Bajusz et al.

[11] 4,057,354

[45] Nov. 8, 1977

[54] NIB AND SHIELD FOR WRITING IMPLEMENT

[76] Inventors: Harold F. Bajusz, 379 Innes Road, Woodridge, N.J. 07075; Nobuhiro Iino, 94-2, Shimo-Hideya, Okegawa, Saitama, Japan, 363

[21] Appl. No.: 678,747

[22] Filed: Apr. 21, 1976

[51] Int. Cl.[2] ..... B43K 5/00

[52] U.S. Cl. ..... 401/199; 401/292

[58] Field of Search ..... 401/198, 199, 292

[56] References Cited

U.S. PATENT DOCUMENTS

| | | | |
|---|---|---|---|
| 1,205,920 | 11/1916 | Miura | 401/258 |
| 3,353,899 | 11/1967 | Hechtle | 401/198 |
| 3,424,539 | 1/1969 | Jenkins | 401/292 |
| 3,507,600 | 4/1970 | Cress | 401/258 |
| 3,776,646 | 12/1973 | Bich | 401/199 |
| 3,933,965 | 1/1976 | Gallone et al. | 401/292 X |
| 3,969,027 | 7/1976 | Randar et al. | 401/292 |

FOREIGN PATENT DOCUMENTS

| | | | |
|---|---|---|---|
| 1,250,302 | 9/1967 | Germany | 401/199 |

*Primary Examiner*—Stephen C. Pellegrino
*Attorney, Agent, or Firm*—Finnegan, Henderson, Farabow & Garrett

[57] ABSTRACT

A nib and shield for a writing implement are coextruded of plastic material. The shield is coextensive with the nib over a major portion of its length and reinforces the nib substantially throughout its length. The shield terminates at one end short of the end of the nib to expose the writing point. The shield also terminates short of the opposite end of the nib to expose the nib end for reception in an ink wad within the writing implement. The inner end of the shield is tapered to provide a lead-in when the nib and shield are inserted into the open end of the barrel of the writing implement.

2 Claims, 7 Drawing Figures

NIB AND SHIELD FOR WRITING IMPLEMENT

The present invention relates to writing implements and particularly relates to a novel and improved nib and shield for writing implements.

In known writing implements, there is conventionally provided an elongated nib and an annular shield which encompasses an end of the nib and secures it within the writing implement. Conventionally, the nib is inserted into the shield and the shield is spun and crimped to secure the nib to the shield. This nib and shield combination is then inserted into the open end of the barrel of the writing implement. The end of the nib which projects from the shield and from the barrel forms the writing tip.

It will be appreciated that such nib is conventionally formed of a plastic material while the shield is formed of metal. When the nib and shield are inserted into the barrel of the writing implement, the inner end of the nib is received in an ink reservoir, conventionally an ink saturated fiber wad. The ink, by capillary action, flows from the ink wad along the nib to the writing tip.

Various problems are evident from the manufacture and use of writing implements having the foregoing described nib and shield construction. For example, excess pressure is not frequency applied to the shield when crimped to the nib. This often axially displaces the writing point of the nib relative to the shield such that the writing point does not project beyond the tip of the shield. Thus, only the metal shield is exposed and, of coure, the implement cannot be utilized for writing purposes. Further, the prior plastic nib is too flexible to permit its insertion into the shield by automated manufacturing processes. Thus, insertion of the nib into the shield is normally accomplished manually and this is, of course, laborious and expensive.

Problems also arise when the nib and shield combination is inserted into the open end of the barrel of the writing implement. For example, the nib is sometimes flexed or broken upon insertion into the barrel such that the end of the nib opposite the writing point does not reach into or lie in contact with the ink wad. Thus, ink cannot flow along or through the nib to the writing point. This problem is compounded by the high flexibility of the nib which permits it to hang up or snag on parts of the barrel during insertion. The flexibility of and the lack of support or reinforcement for the nib along its length is therefore a problem both in assembling the nib and shield combination and inserting it into the barrel of the writing implement. While applicant has considered lengthening the metal shield as a possible solution to this problem, the cost of such excess metal material renders the writing implement substantially more expensive and non-competitive.

Consequently, there has arisen a need for an improved nib and shield for a writing implement which, in general, minimizes or eliminates the foregoing and other disadvantages or prior nib and shield constructions and arrangements, and which can be inexpensively manufactured, and readily and easily applied to the writing implement in such a manner that the end of the nib will properly seat in the ink reservoir.

Accordingly, it is a primary object of the present invention to provide a novel and improved nib and shield combination for a writing implement.

It is another object of the present invention to provide a novel and improved nib and shield combination for a pen wherein the nib is substantially reinforced throughout the majority of its length thus faciliating insertion of the nib and shield combination into the barrel of the pen.

It is still another object of the present invention to provide a novel and improved nib and shield combination for a pen having an ink reservior and which combination ensures seating of the inner end of the nib in the ink reservoir upon insertion of the nib and shield combination into the barrel of the pen.

It is a further object of the present invention to provide a novel and improved nib and shield combination for a pen wherein the nib and shield is formed inexpensively by a coextrusion process and of a plastic material.

It is a still further object of the present invention to provide a writing implement having a novel and improved nib and shield combination having the foregoing characteristics.

Additional objects and advantages of the invention will be set forth in part in the description which follows and in part will be obvious from the description, or may be learned by practice of the invention. The objects and the advantages of the invention may also be realized and attained by means of the instrumentalities and combinations particularly pointed out in the appended claims.

To achieve the foregoing objects and advantages and in accordance with the purpose of the present invention, as embodied and broadly described herein, the nib and shield combination of this invention comprises an elongated flexible nib having a writing point at one end and a tip at its opposite end for transmitting ink from the ink reservoir within the writing implement adjacent such opposite end along the nib to the writing point, and a shield which encases the nib and terminates at one end short of the corresponding end of the nib to expose the writing point, the shield extending from that end over the major portion of the length of the nib thereby reinforcing the nib against flexing movement in a direction transverse to its length. Preferably, the nib and shield are formed of coextruded plastic materials, the shield being formed of a plastic material less flexible than the material forming the nib. The shield also preferably lies in continuous engagement with the nib substantially throughout the portion of the nib which is coextensive with the shield, the shield encasing the nib for at least 70 percent of the length of the nib. The opposite end of the shield from the writing point of the nib and shield combination is preferably tapered to provide a lead-in when the nib and shield combination is inserted into the open end of the barrel of the writing implement.

The invention consists in the novel parts, constructions, arrangements, combinations and improvements shown and described. The accompanying drawings, which are incorporated in and constitute a part of this specification, illustrate one embodiment of the invention and, together with description, serve to explain the principles of the invention.

IN THE DRAWINGS

Figure 1:
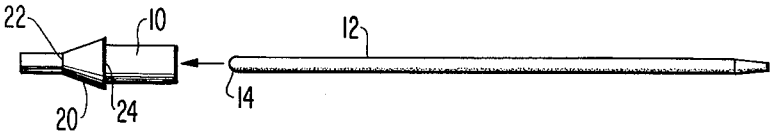
FIG 1 (PRIOR ART)
FIG. 1 is a side elevational view of a nib and shield constructed in accordance with the prior art and illustrated in an unassembled condition.
Figure 1A:
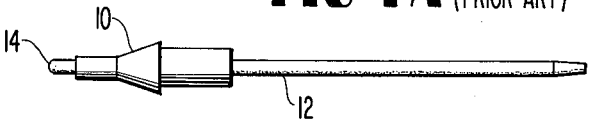
FIG 1A (PRIOR ART)
FIG. 1A is a view similar to FIG. 1 but with such prior art nib and shield in an assembled condition.
Figure 1B:
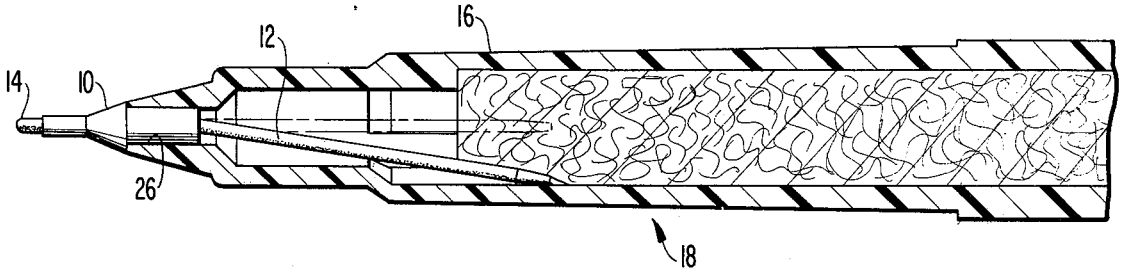
FIG 1B (PRIOR ART)
FIG. 1B is a fragmentary longitudinal cross-sectional view through a writing implement illustrating the prior art nib and shield secured thereto.
Figure 2:
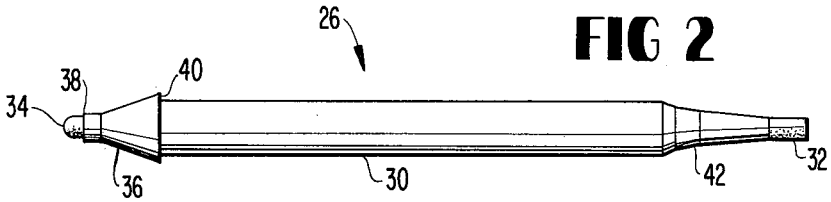
FIG. 2 is a side elevational view of a nib and shield combination constructed in accordance with the present invention.

Referring now to the prior art nib and shield combination and such combination within the barrel of a writing implement as respectively illustrated in FIGS. 1, 1A and 1B, such prior art combination includes a shield 10 and a nib 12. The nib 12 is conventionally a thin elongated flexible rod formed of a plastic material which may be porous or grooved axially or otherwise depending upon the manner in which ink from an ink reservoir within the writing implement is transmitted along the nib to its writing point 14. Shield 10 is conventionally formed of a metal material and as illustrated in these drawing Figures, is generally annular and cylindrical in shape throughout its length. More specifically, the prior art metal shield 10 termintes at one end in a frustoconical section 20 which is of reduced diameter at its terminus 22 and at its opposite end in an enlarged diameter to form an annular shoulder 24.

To assemble the prior art nib and shield, nib 12 is inserted endwise into the annular shield 10. In accordance with conventional prior practice, the shield is then spun and crimped to the nib.

FIG. 1B illustrates the prior art nib and shield combination of the type illustrated in FIGS. 1 and 1A disposed within the open end of the barrel 16 of the writing implement, i.e., a pen, generally designated 18. When the prior art nib and shield is inserted into the open end 26 of the pen barrel 16, the nib is intended to lie substantially coaxial within the barrel as indicated by the dashed lines of FIG. 1B. The nib very frequently, however, and due to its flexible nature, is canted to one side such that it bears against the wall of the barrel. This is illustrated by the full line position of nib 12 in FIG. 1B. Depending upon the interior construction of the barrel, the nib end may also sometimes snag or break against the barrel upon insertion. This results in either insufficient or complete failure of ink to flow along the nib to the writing point.

Reference will now be made in detail to the present preferred embodiment of the invention, an example of which is illustrated in the accompanying drawing FIGS. 2–5.

In accordance with the present invention, there is provided a nib and shield combination generally designated 26 and including a nib 28 and shield 30. The nib 28 comprises an elongated rod formed of a plastic resin and which rod is preferably porous for transmittal of ink from its inner end 32 to its writing point or tip 34. The nib 28 may be formed of other materials and need not necessarily be formed of a porous material. For example, the nib may be non-porous and have axial grooves for transmitting the ink along the nib. Shield 30 is formed of a plastic resin which is preferably stronger than the material forming the nib. The shield 30, for example, may be formed of a substantially non-porous plastic material known by the tradename "Delrin". Such plastic material does not accept ink and serves as an insulator between ink flowing through the nib 28 and its surrounds.

Figure 3:
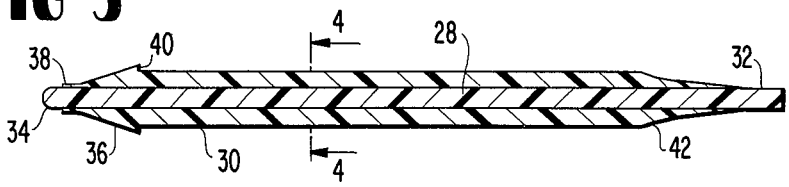
FIG. 3 is a longitudinal cross-sectional view thereof.
Figure 4:
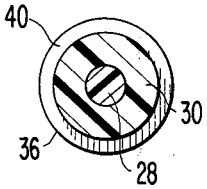
FIG. 4 is a cross-sectional view thereof taken generally about on line 4—4 in FIG. 3.

As best illustrated in FIG. 3, shield 30 extends over the major portion of the length of nib 28 and preferably for at leastn 70 percent of its length from a location directly adjacent the writing tip 34 toward the opposite end of nib 28. The end of shield 30 adjacent the writing tip 34 is formed to provide a frustoconical section 36 which terminates directly adjacent writing tip 34 in a reduced diameter end 38. The portion of frustoconical section 36 remote from end 38 has an enlarged diameter which defines an annular shoulder 40. The opposite end 42 of shield 30 is tapered to provide a lead-in to the open end of the barrel of the writing implement as described hereinafter. The portion of shield 30 intermediate section 36 and tapered end 42 is substantially constant in diameter.

Preferably, and in accordance with the present invention, nib 28 and shield 30 are coextruded. Thus, they are integrally secured one to the other in the manufacturing process. By coextruding the nib 28 and shield 30 optimum control over the configuration and dimensions of the nib and shield combination may be obtained. After the combination is coextruded the writing tips 34 are formed by a sharpening process and the end 32 of the nib is cut such that coextruded nib and shield combinations have like lengthwise dimensions. It will be appreciated that the coextrusion process is thus considerably less costly than prior methods for manufacturing and assembling nib and shield combinations.

Furthermore, by extruding the nib and shield and extending the shield over the major portion of the length of the nib, i.e. at least 70 percent of its length, the flexible porous nib is substantialy reinforced throughout its length. The nib and shield combination additionally retains its linearity. That is, it does not tend to bend in a direction transverse to its longitudinal axis but rather maintains a rod-like rigidity.

Figure 5:
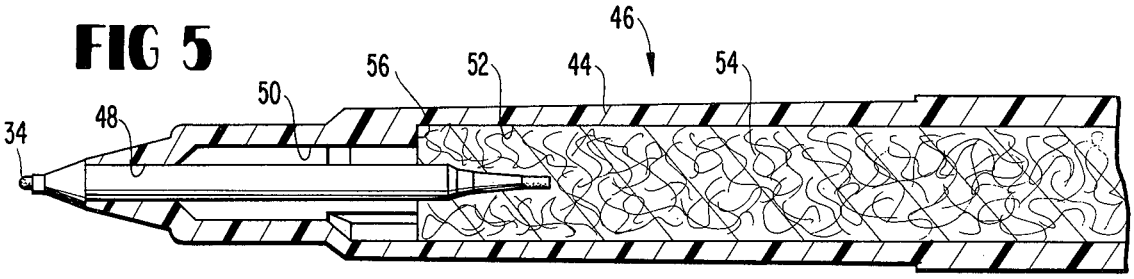
FIG. 5 is a fragmentary longitudinal cross-sectional view of a writing implement with the novel and improved nib and shield combination of the present invention secured therein in operable writing condition.

Referring to FIG. 5, the barrel 44 of the writing implement, generally designated 46, is provided with an end opening 48 which, for reasons noted hereinafter, is of the same diameter as the diameter of the intermediate portion of shield 30. The interior of barrel 44 is provided with a pair of different chambers 50 and 52. Chamber 52 defines an enlarged diameter cavity in which is inserted a fiber, ink saturated, wad 54. The end of wad 54 butts a shoulder 56 which divides chamber 52 from the reduced diameter chamber 50. When the nib and shield combination 26 is inserted into the end opening 48 of barrel 44, the tapered end 42 of shield 30 serves as a lead into the opening 48 thereby facilitating such insertion. When fully inserted with the shoulder 40 butting the end of barrel 44, the end 32 of nib 28 is substantially coaxially received within barrel 44 and also lies within the ink filled fiber wad 54 as illustrated in FIG. 5. The substantially rigid linear configuration of nib and shield combination 26 insures that, upon its insertion into the pen barrel, the inner end 32 of nib 28 lies substantially coaxially with opening 48 and penetrates ink wad 54 substantially along its longitudinal axis. It will be appreciated that the end of tapered portion 42 of shield 30 terminates short of the end of nib 28. Thus, the end and sides of end 32 of nib 28 are fully exposed to the ink in the fiber wad thereby assuring continuous and unihibited flow of ink along nib 28 to the writing tip or point 34.

It will be recalled that the diameter of the intermediate portion of shield 30 is the same as the diameter of the opening 48 into barrel 44. Thus, when the nib and shield combination is fully inserted into the barrel 44 with shoulder 40 finally seated against the end of the barrel, the force or press fit between the nib and shield combination on the one hand and the barrel on the other hand serves to finally retain and secure the nib and shield combination in the writing implement.

It will be apparent to those skilled in the art that various modifications and variations could be made in the containers of the invention without departing from the scope or spirit of the invention.

We claim:

1. A writing implement comprising an elongated barrel having an opening at one end, means within said barrel defining an ink reservoir spaced from said one end, said barrel having side walls located between said ink reservoir and said one barrel and defining an elongated chamber therebetween, an elongated flexible nib having a writing point at one end and a tip at its opposite end, a shield encasing said nib and terminating at one end short of said one nib end to expose the writing point at the one shield end, said nib and said shield being coaxially inserted into the opening at one end of said barrel with the tip of said nib lying in communication with said ink reservoir for transmitting ink from said ink reservoir along said nib to said writing point, said shield extending within said chamber and being spaced from the side walls thereof, said shield extending from said one shield end over the major portion of the length of said nib for reinforcing said nib against flexing movement within said chamber in a direction transverse to its length, and means for retaining said nib and said shield in said barrel, said nib and shield being formed of different plastic materials coextruded one with the other, said shield being formed of a plastic material stronger than the plastic material forming said nib, said shield lying in continuous engagement with said nib substantially throughout the portion of said nib which is coextensive with said shield, said shield encasing said nib for at least 70% of the length of said nib and having a laterally enlarged portion at said one end thereof forming a shoulder engaging the margins of the barrel about said opening when said shield and said nib are inserted into and retained within said barrel, said shield being cylindrical in cross section and being substantially constant in cylindrical cross section for the portion of its length within said chamber and barrel opening said shield having a reduced diameter portion adjacent its opposite end tapering toward the tip of said nib and terminating short of said tip, said ink reservoir including an ink saturated fiber wad, said shield terminating at its opposite end short of the tip of said nib, said tip being received within said fiber wad and exposed laterally for communication with the ink in said reservoir.

2. A writing implement according to claim 1 wherein said shield extends completely through said chamber with its opposite end extending into said ink reservoir.

* * * * *

UNITED STATES PATENT AND TRADEMARK OFFICE

CERTIFICATE OF CORRECTION

PATENT NO. : 4,057,354

DATED : November 8, 1977

INVENTOR(S) : Harold F. Bajusz et al

It is certified that error appears in the above-identified patent and that said Letters Patent are hereby corrected as shown below:

Claim 1, line 5, after "one" and before "barrel" insert:

--end of said--.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*